United States Patent [19]

Fogleman

[11] 4,249,407

[45] Feb. 10, 1981

[54] APPARATUS FOR BENDING STEEL TUBES

[76] Inventor: Boyd C. Fogleman, 2170 Herron Rd., Whitsett, N.C. 27377

[21] Appl. No.: 26,353

[22] Filed: Apr. 2, 1979

[51] Int. Cl.[3] ..... B21D 7/024

[52] U.S. Cl. ..... 72/217; 72/159

[58] Field of Search ..... 72/218, 217, 159, 219, 72/216

[56] References Cited

U.S. PATENT DOCUMENTS

| | | | |
|---|---|---|---|
| 828,338 | 8/1906 | Reynolds | 72/217 |
| 1,136,252 | 4/1915 | Meier | 72/219 |
| 1,277,235 | 8/1918 | McKenna | 72/219 |
| 4,090,387 | 5/1978 | Dubreuil | 72/217 |

*Primary Examiner*—Milton S. Mehr

[57] ABSTRACT

A generally circular die is mounted on a rotatable shaft in non-rotatable relation thereto. The periphery of the die is formed by a plurality of separate arcuate (circular) portions curved along a path equal in radius to the desired radius of curvature of the bend in the different size pipes being bent. Each of the arcuate portions includes a hemispherical recess having a diameter differing from the others and substantially equal to the outer diameter of the tube being bent in that particular arcuate portion. A force transmitting member is secured by an arm to the aforementioned vertical shaft and is rotatable therewith. The surface of the force transmitting member is provided with a plurality of separate arcuate portions, each having a hemispherical recess therein corresponding to those on the corresponding portion on the die face opposite.

A segment of each arcuate portion of the die includes a plurality of teeth or studs implanted therein which grip the surface of the pipe positioned therein and resist relative sliding movement between the pipe and the arcuate portions of the die. The force transmitting member is connected to the die by means of a support arm, which so positions the force transmitting member with respect to the die that it extends outwardly beyond the surface of the die a distance substantially greater than the diameter of the pipe being held therein.

7 Claims, 5 Drawing Figures

APPARATUS FOR BENDING STEEL TUBES

BACKGROUND OF THE INVENTION

In the metal working arts it often becomes necessary to bend a steel tube or conduit for one purpose or another. Some examples of pipe bending requirements include the fabrication of steel loops which form the dividers of cattle stalls as illustrated in U.S. Pat. to Anderson No. 3,726,257; in the plumbing art; in the formation of electrical conduits by electricians and other situations in which it becomes necessary to bend pipes. There are various known pipe bending apparatuses or appliances. Most popular of such types include a circular die which is pushed against the central portion of a pipe being restrained on opposite sides of the die by stop members. As the die is pushed between the stop members the conduit assumes basically a U-shape. Because the stop members are generally stationary, it is not possible to accomplish an overbend sufficient to allow for the resiliency of the metal, so that after the pipe is formed into its U-shape and removed from the die the legs tend to spring outwardly and are not really parallel. In order to further complete the bend to make the legs absolutely parallel becomes a time consuming and expensive procedure.

Several apparatuses have been developed in which one end of a pipe is held while the remainder of the pipe is bent around a circular die by a rotating force transmitting member. Such apparatuses are disclosed in U.S. Pat. to Middleton No. 2,762,416; Paine No. 3,546,917; Sakamato No. 4,052,875; and Shimizer No. 4,009,601. While it is possible to more easily realize a true parallel relationship between the legs of the resulting U-shaped member with such devices there are various problems which have arisen and which have not to date been solved. One such problem exists when the force transmitting member rotates around the stationary circular die, there is a tendency for the pipe to slip and be pulled along the periphery of the circular die, so that it is impossible to establish a resulting U-shaped member in which the legs are of equal length. In other words, it is difficult to maintain one end of the pipe back against a stop member as the force transmitting member tends to pull the pipe away from such stop member.

Another problem exists when the force transmitting member is rotated with respect to the circular die, if the force transmitting member is positioned too close to the peripheral surface of the die, the walls of the pipe will tend to collapse inwardly before the pipe as a whole begins to bend. Therefore, a wrinkled or collapsed wall configuration will occur in the area of the bend which may become unsightly or, even worse in the case of a conduit through which a fluid passes, may cause inconsistent cross-sections with a resulting adverse effect on the fluid dynamics of the system.

Also with such known apparatuses as are disclosed in the aforementioned prior patents it becomes necessary to change dies whenever a pipe or conduit of a different diameter is desired to be bent. In some industries or craft, it is very important to be able to bend pipe of different diameters, rather than always bending a pipe of the same diameter.

SUMMARY OF THE PRESENT INVENTION

The present invention, on the other hand is directed to a very versatile, simple, but effective pipe bending apparatus generally of the type mentioned above in which there is provided a stationary die and a rotating force transmitting member which bends the pipe around the circular die, but in which environment the aforementioned problems have been eliminated. In the apparatus according to the present invention a stationary or nonrotatable die is mounted on a rotatable, vertically oriented shaft. The die includes a plurality of arcuate peripheral portions each of which is curved along a prescribed radius. Each of the arcuate peripheral portions also include a hemispherical recess curved from top to bottom with the diameter of the recess being substantially equal to the outer diameter of the pipe being bent. A rotatable force transmitting member is secured to and extends radially from the rotatable vertical shaft to which the die is mounted. The rotatable force transmitting member extends outwardly beyond the periphery of the die a distance greater than the diameter of the pipe being bent. A rotating means such as a gear box or transmission operated from a hydraulic motor selectively rotates the shaft and thus the force transmitting member relative to the periphery of the die, whereby a tube positioned between the force transmitting member and the die is caused to assume a bend having the same radius of curvature as the die. A hold-back means preferably in the form of a plurality of studs or sharp teeth elements are embedded in a segment of the die in each of the arcuate portions. These teeth or sharp projections bite into the surface of the pipe as it is positioned therein and tend to cause it to remain stationary and thus resist the normal tendency to slide around the die as the force transmitting member is rotated therearound.

In order to prevent collapse of the wall and to ensure that a sufficient torque is applied to the pipe to cause bending thereof, the force transmitting member is spaced outwardly from the periphery of the die a distance at last equal to approximately two diameters of the pipe being bent, whereby engagement of the pipe occurs at a point spaced from the periphery of the die and results in a bending of the pipe, rather than a wall collapse as all of the torque being applied is transferred to the bending action, rather than being absorbed by the wall itself.

Finally, in order to provide for the bending of a plurality of sizes of pipe, the die includes a plurality of stacked arcuate portions, each of the portions having a hemispherical recess of a different diameter from the others, whereby one pipe may be placed in the recess most suitable, and therefore a larger number of sizes of pipes may be bent than would be the case if only a single peripheral portion with one size of recess were provided.

It is therefore an object of the present invention to provide an improved pipe bending apparatus.

It is another object of the present invention to provide an improved pipe bending apparatus of the type described in which a hold-back means is built into the die thereof, so that a pipe being bent will resist its normal tendency to slide relative to the surface of the die.

It is yet another object of the present invention to provide an improved pipe bending apparatus of the type described in which a force transmitting member is positioned at a spaced distance from the periphery of the die so that the force exerted by the member is mostly directed to bending of the pipe rather than being applied against the wall which would cause collapse of the wall.

It is still another object of the present invention to provide an improved pipe bending apparatus of the type described in which a single die may be utilized in the bending of a plurality of sizes or diameters of pipes.

Other objects and a fuller understanding of the invention will become apparent after reading the following detailed description of a preferred embodiment along with the accompanying drawings in which.

Figure 3A:
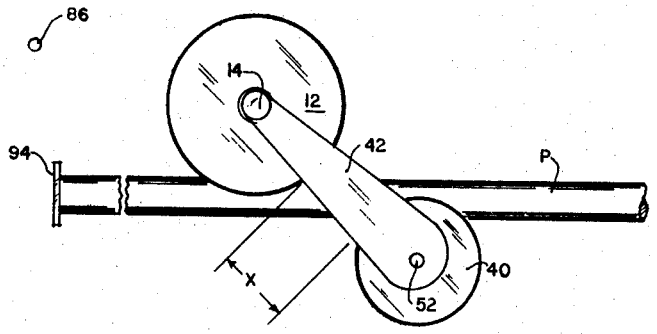
Figure 3B:
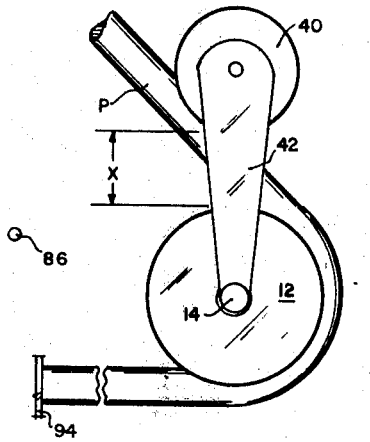
Figure 3C:
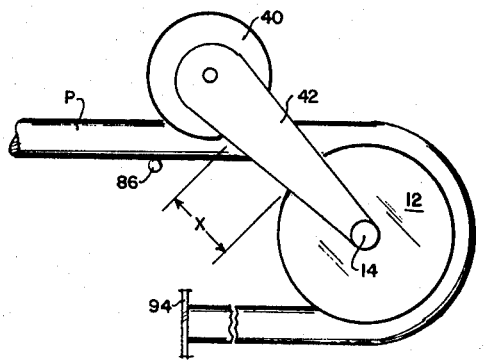

FIGS. 3*a*, 3*b*, and 3*c* are schematic plan views illustrating successive stages in the bending of a pipe according to the present invention.

DETAILED DESCRIPTION OF PREFERRED EMBODIMENT

Turning now to the drawings there is illustrated the apparatus for bending steel tubes according to the present invention. In this regard, and in general the invention includes a non-rotatable die means 12 mounted on a rotatable, vertically oriented shaft 14. The surface of the die means 12 is made up of a plurality of stacked arcuate peripheral portions 16, 18, 20 and 22, each of which is curved along a radius equal to the radius of a desired bend to be fabricated into the tube. Each arcuate peripheral portion 16, 18, 20, 22 is recessed substantially hemispherically in a direction perpendicular to the periphery and substantially equal in diameter to the outer diameter of the tube being bent.

A force transmitting member 40 is secured to and extends radially from shaft 14 by means of a support arm 42. Arm 42 is of such length and attached to the force transmitting member 40 at such a position that member 40 extends beyond the periphery of the die means a distance greater than the diameter of the tube being bent for reasons to be described more fully hereinafter.

The lower end of rotatable shaft 14 is operatively connected to a means 60 for selectively rotating shaft 14 and said force transmitting member 40 relative to the periphery of the die 12, whereby a pipe or tube P, when inserted into the apparatus is caused to be bent or assume a bend having the same radius of curvature as the die 12. A hold-back means 24 associated with the die 12 prevents relative slippage between the tube and the die whereby the pipe or tube P being bent is prevented from slipping relative to the peripheral surface of the die 12.

Figure 1:
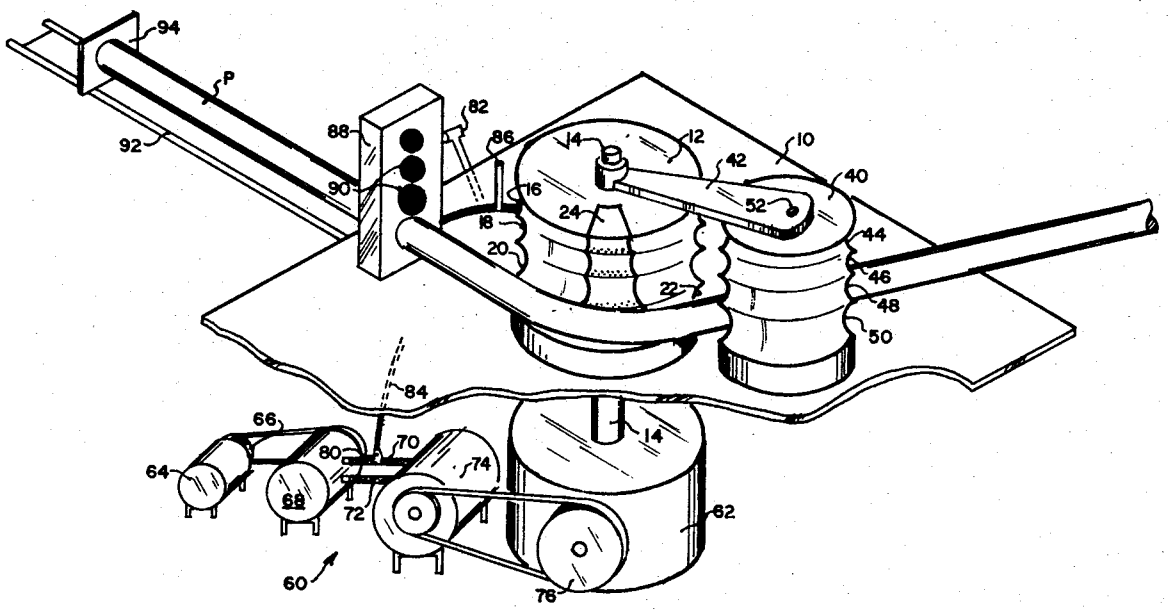
FIG. 1 is a perspective view with parts broken away for the sake of clarity, illustrating the apparatus according to the present invention.
Figure 2:
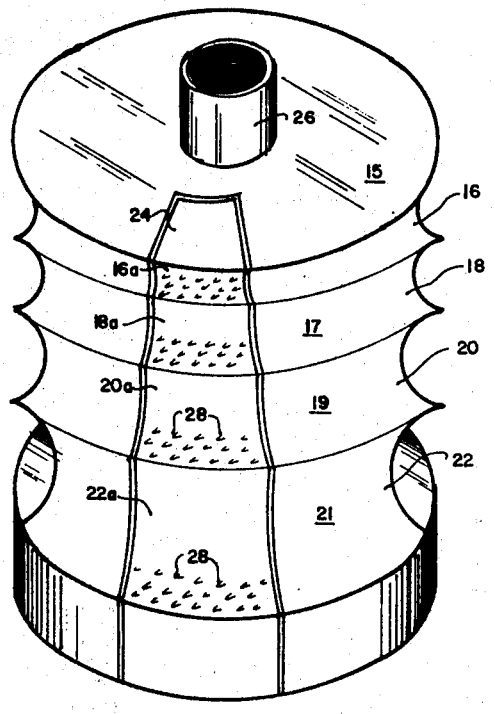
FIG. 2 is an enlarged perspective view of the die member itself according to the present invention.

Looking now at the more detailed characteristics of these components, die 12 is mounted on a table 10, which in turn is provided with an opening (not shown) through which shaft 14 extends. As illustrated in FIG. 2, the die 12 is generally cylindrical in shape and includes a plurality of basically disc-shaped plates 15, 17, 19, and 21. Each plate is of a different thickness and includes vertical hemispherical recesses in the outer periphery thereof and when assembled form the curved arcuate portions 16, 18, 20 and 22. The disc-shaped members 15, 17, 19, 21 may be formed integrally, or they may preferably be formed separately and attached to a connecting sleeve 26 which extends centrally through an opening in each of the discs to form the stacked die 12. The sleeve 26 then slides over the shaft 14 which rotates thereinside while the die remains stationary. Along one side of the die which coincides with the tangential point at which the pipe P first engages the die as it is positioned on the apparatus, a segmented portion 24 is provided which may be selectively removed from the die 12 as will be hereinafter described. The segment 24 includes a plurality of stacked elements having arcuate peripheral portions **16*a*, 18*a*, 20*a*, and 22*a* which, when secured to the die, form a colinear continuation of the peripheral portions 16, 18, 20, and 22. The aforementioned hold-back means 24 is provided by embedding into the recess of the arcuate portion 16*a*, 18*a*, 20*a*, and 22*a* a plurality of studs or teeth 28. As then best illustrated in FIG. 1 when the pipe P is emplaced in the apparatus the teeth engage the surface of the pipe where it engages die 12, and provide a resistance to slippage which would normally occur when the forced transmitting member 40 rotates around the die 12**, unless such hold-back means were provided.

The die 12 illustrated in FIGS. 1 and 2, as mentioned hereinabove, is provided with a plurality of acruate portions 16, 18, 20, 22, each of which may be of the same radius of bending curvature, as illustrated, or each of which may be of a different radius of curvature. Further, each of the hemispherical recesses forming the periphery of the acruate portions is of a different diameter so that pipes of different sizes may be bent on the same die. For example, in the illustrated embodiment, arcuate portion 16 is provided with a recess having a diameter of one inch, arcuate portion 18 is provided with a recess having a diameter of one and one-half inches, arcuate portion 20 is provided with a recess having a diameter of one and one-half inches, and arcuate portion 22 is provided with a recess having a diameter of two inches. It is apparent that the diameters of the recesses may be varied from die to die. Also, the radius of curvature of bends being formed may be varied on a particular die by providing the disc-shaped members 15 of different diameters. Even though it would be impossible to provide a single die which would have an infinite number of bending radii and an infinite number of recesses to hold various sizes of pipes, it is believed that providing a plurality of such arcuate portions to provide for some flexibility as far as size is concerned would reduce to a substantial extent the number of times a die had to be removed when various sizes of pipes or tubes are being bent.

Turning now to a discussion of the rotatable force transmitting member 40, here again the member 40 is generally cylindrical in shape made up of a plurality of disc-shaped arcuate portions 44, 46, 48, and 50 which may either be formed separately or integrally. The side surface or wall of the member 40 is positioned in confronting relationship to the recessed portions 16, 18, 20, 22 of the die 12. Each of portions 44–50 also includes a hemispherical recess extending perpendicular to the periphery of the disc-shaped portions and corresponding in size and shape to the opposed recesses in the die 12. It is not necessary that the disc-shaped arcuate portions 44–50 of the force transmitting member 40 be of the same diameter as the diameter of the disc-shaped portions of the die 12, because it does not create the bending radius. The force transmitting member 40 includes a rod 52 extending down through the center of the disc-shaped portions about which the force transmitting member 40 revolves. Further, the rod 52 is connected to the outer extremity of the support arm 42 whereby rotation of shaft 14 will cause an arcuate motion of arm 42 and force transmitting member 40. In addition, the disc-shaped portions 44–50 of force transmitting member 40 revolve about the rod 52 on which they are mounted as the pipe is bent to prevent drag along the surface of the pipe P.

As best illustrated in FIGS. *3a–3c* the support arm 42 which connects the force transmitting member 40 to the die 12 is of such length that there is a considerable space or area between the peripheral portion of the die 12 and the peripheral portion of the force transmitting member 40. This space may vary, however, it is felt that to effectively prevent collapse of the wall of the tube being bent, this distance x should be at least two inches when working with steel pipes of the range of diameters described hereinabove. So arranged, sufficient torque will be applied to the pipe to cause a bending action thereon rather than causing a squeezing or collapsing of the walls. This is quite different from any arrangement shown by any of the prior art known to the applicant, in which cases the force transmitting members are generally very close to the surface of the die means.

Connected to the lower end of vertical shaft 14 is the aforementioned means 60 for selectively rotating the shaft 14 and force transmitting member 40. Rotating means 60 includes a step-up gear box or transmission 62 operatively connected on the output side to shaft 14. An electric motor 64 has a pulley 66 connected to the output shaft thereof, which in turn connects the motor 64 to a pump 68. A pair of conduits 70, 72 hereinafter referred to as supply conduit 70 and return conduit 72 are provided between pump 68 and a hydraulic motor 74. The output shaft of hydraulic motor 74 is connected by a pulley 76 to the input of transmission 62.

An on-off fluid control valve 80 is positioned in the supply line 80 between pump 68 and hydraulic motor 74 and is activated responsive to a lever 82 manually operated by the operator of the machine to open the valve through a mechanical linkage 84 between the lever 82 and the valve 80. An adjustable stop pin 86 is positioned in the path of the pipe P as it is rotated around die 12. As the pipe P engages the stop pin 86, a conventional mechanical linkage between the stop pin 86 and the lever 82 acts through the linkage 84 to deactivate the valve 80 moving it to the off position, thereby stopping flow of fluid through supply line 70. Thus, the apparatus of the present invention can be so adjusted that the movement of force transmitting member 40 is halted when a desired bend has been put in the pipe P.

A support block 88 is mounted on table 10 and extends vertically upwardly therefrom. A plurality of openings 90 are aligned with the various peripheral portions 16, 18, 20, and 22, so that when a pipe of a specified size is emplaced, it is placed through the appropriate one of the openings 90 in the support block 88 which causes the pipe to be guided into an appropriate one of the peripheral portions 16, 18, 20, 22. In this regard, then, each of the openings 90 correspond in size and shape to a different size of pipe and to one of the peripheral portions. It should be apparent that the diameter of the openings 90 thus correspond to and are approximately equal to the diameters of the hemispherical recesses of each of the peripheral portions.

A support bracket 92 extends outwardly from the edge of table 10 along a line generally parallel to the position of pipe P when emplaced in position, and a stop plate 94 is adjustably positioned on bracket 92.

The operational sequence of events which occur during the bending of a pipe on the apparatus according to the present invention is as follows. An elongated pipe or sleeve P is first positioned, as illustrated in FIG. 1, by extending the pipe through one of the openings 90 corresponding in diameter to the pipe being bent. Pipe P is pushed through the appropriate opening 90 adjacent the corresponding arcuate portions 16, 18, 20 or 22 of die 12 with the force transmitting member 40 being positioned in its "home" position on the opposite side of the pipe from the die 12. The pipe is then moved back into engagement with the stop plate 94. The operator then activates lever 82 to open valve 80 and allow operation of the hydraulic motor 74, which is practically instantaneous. The hydraulic motor 74 operating through the transmission 62, then is effective to begin turning shaft 14 in a counterclockwise direction as illustrated in FIG. *3a* until the force transmitting 40 engages the opposite surface of pipe P from that which engages the die 12. As rotation of shaft 14 continues (illustrated in FIGS. *3b* and *3c*) the pipe is caused to bend around the die means until the pipe engages stop pin 86, whereupon valve 80 is then closed, shutting off the operation of hydraulic motor 74. Prior adjustment of stop plate 94 along bracket 92 causes the opposed ends of pipe P to be equal in distance from the curve or bend in the pipe. Support arm 42 is then caused to return to its original or "home" position by means of a spring action (not shown) or by reversal of the hydraulic motor 74 which can be accomplished by known conventional procedures. Upon return of the force transmitting member 40 to its "home" position the operator then pushes or pulls the bent pipe or loop toward the right as illustrated in FIG. 1, thereby removing it from the apparatus.

Although a preferred embodiment of the invention has been described in detail hereinabove, it is apparent that various changes and modifications might be made without departing from the scope and intent of the invention which is set forth and limited only by the following claims.

What is claimed is:

1. Apparatus for bending steel tubes comprising:

(a) a non-rotatable die means mounted on a rotatable, vertically oriented shaft, said die means having at least one arcuate peripheral portion curved along a prescribed bending radius, said arcuate portion further including a recess therealong, the effective diameter of said recess being substantially equal to the outer diameter of the tube being bent;

(b) a rotatable force transmitting member secured to and extending radially from said shaft beyond the periphery of said die means a distance greater than the diameter of said tube and having a side surface positioned in confronting relationship to the recessed peripheral portion of said die means;

(c) means for selectively rotating said shaft and said force transmitting member relative to the periphery of said die means whereby a tube is caused to assume a bend having said bending radius; and (d) hold-back means associated with said die means for preventing relative slippage between said tube and said die means, whereby a tube being bent is prevented from slipping relative to the peripheral surface of the die.

2. The apparatus according to claim 1 wherein said die means includes a plurality of said arcuate peripheral portions, the hemispherical recess of each of said portions being of a different radius from the others.

3. The apparatus according to claim 2 wherein said force transmitting member comprises a rotatable generally cylindrical member, the surface of which includes a plurality of arcuate peripheral portions corresponding in number to the number of portions on said die means and each of said peripheral portions on said force transmitting member including a hemispherical recess therealong similar in radius to the recess on the opposed surface of the die.

4. The apparatus according to claim 1 wherein said force transmitting member comprises a rotatable generally cylindrical member, a support arm connecting said rotatable, vertically oriented shaft with said force transmitting member, the length of said support arm being such that said side surface of said force transmitting member is spaced from the confronting surface of said die means by a distance at least as great as two inches.

5. The apparatus according to claim 1 wherein said hold-back means comprises a plurality of studs or teeth in the surface of the recess along at least the area of the peripheral portion of the die where the pipe being bent initially engages the die when first positioned for bending.

6. The apparatus according to claim 5 where said studs or teeth are imbedded in a removable segment of said die means for easy removal and sharpening.

7. An apparatus for bending steel tubes comprising:

(a) a non-rotatable die means mounted on a rotatable, vertically oriented shaft, said die means having at least one arcuate peripheral portion curved along a prescribed bending radius, said arcuate portion further including a recess therealong, the effective diameter of said recess being substantially equal to the outer diameter of the tube being bent;

(b) a rotatable force transmitting member secured to and extending radially from said shaft beyond the periphery of said die means a distance at least as great as two inches and having a side surface positioned in confronting relationship to the recessed peripheral portion of said die means;

(c) means for selectively rotating said shaft and said force transmitting member relative to the periphery of said die means whereby a tube is caused to assume a bend having said bending radius; and (d) holdback means associated with said die means for preventing relative slippage between said tube and said die means, said holdback means comprising a plurality of studs or teeth in the surface of the recess along at least the area of the peripheral portion of the die where the pipe being bent initially engages the die when first positioned for bending, whereby a tube being bent is prevented from slippage relative to the peripheral surface of the die.

* * * * *